US006526741B2

(12) United States Patent
Whitehead et al.

(10) Patent No.: US 6,526,741 B2
(45) Date of Patent: Mar. 4, 2003

(54) METHOD AND APPARATUS FOR REMOVING ALKALI METAL CONTAMINATION FROM GAS TURBINE LIQUID FUELS

(75) Inventors: Alan Whitehead, Ballston Lake, NY (US); Vinod Kumar Pareek, Niskayuna, NY (US); Andrew Philip Shapiro, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/738,862

(22) Filed: Dec. 18, 2000

(65) Prior Publication Data

US 2002/0112481 A1 Aug. 22, 2002

(51) Int. Cl.[7] ..... F02C 1/00
(52) U.S. Cl. ..... 60/39.02; 60/734; 60/336
(58) Field of Search ..... 60/772, 776, 734, 60/39.091, 336, 39.02, 39.092; 210/634, 800; 208/283, 284, 226, 230; 95/8

(56) References Cited

U.S. PATENT DOCUMENTS 1,943,811 A * 1/1934 Child et al. ..... 210/181
3,808,795 A * 5/1974 Lucas ..... 60/39.5
3,912,464 A * 10/1975 Schulz ..... 48/95
4,050,237 A * 9/1977 Pall et al. ..... 60/39.08
4,158,449 A * 6/1979 Sun et al. ..... 244/136
4,292,179 A * 9/1981 Stone et al. ..... 210/443
4,362,630 A * 12/1982 Young ..... 210/745
4,568,365 A * 2/1986 Metcalfe et al. ..... 55/96
5,083,423 A * 1/1992 Prochaska et al. ..... 60/39.02
5,152,146 A * 10/1992 Butler ..... 60/736
5,209,058 A * 5/1993 Sparks et al. ..... 60/39.281
5,329,759 A * 7/1994 Chan ..... 60/39.06

OTHER PUBLICATIONS

"What You Burn Is What You Get"—Jeffrey A. Kain, Middle East Power Generation Summit, Nov. 24, 1999—Dubai, UAE.

* cited by examiner

*Primary Examiner*—Charles G. Freay
*Assistant Examiner*—Han L. Liu
(74) *Attorney, Agent, or Firm*—Nixon & Vanderhye P.C.

(57) ABSTRACT

A system for continuously removing alkali metal contaminants from liquid fuel supplied to a combustor of a gas turbine comprising a source of fuel; means for supplying the fuel to the gas turbine; a prefilter downstream of the source and upstream of the gas turbine for removing solid particulates from the liquid fuel; and a coalescer located downstream of the prefilter and upstream of the gas turbine for separating water containing alkali metals from the liquid fuel.

6 Claims, 1 Drawing Sheet

METHOD AND APPARATUS FOR REMOVING ALKALI METAL CONTAMINATION FROM GAS TURBINE LIQUID FUELS

This invention relates generally to gas turbine fuels, and specifically to a method for removing alkali metal contaminants from liquid fuels.

BACKGROUND OF THE INVENTION

Combustion turbines require fuels with very low contents of the alkali metals, sodium and potassium. This is because at the operating temperatures of the hot gas path components of these turbines, the alloys of which they are constructed can suffer severe corrosion damage if exposed to unacceptable levels of alkali metals contained in the combustion gases. The allowable levels of alkali metals in some conventional gas turbine liquid fuel specifications are shown in Table 1 below.

TABLE 1

| Trace Metal Contaminants, ppm, max | True distillates | Ash Bearing fuels |
|---|---|---|
| Sodium plus potassium | 1.0 | 1.0 |

Certain advanced turbines are designed with higher temperature capability, higher strength alloys and these materials are extremely sensitive to alkali, and thus have even stricter requirements as shown in Table 2 below.

TABLE 2

| Fuel | Alkali Limit |
|---|---|
| Light True Distillates | (Sodium + potassium) |
| Naphtha | 0.4 ppm |
| Kerosene | |
| #2 Distillate | |
| Diesel Fuel | |
| Heavy True Distillate | 0.4 ppm |

Chemical compounds of the alkali metals exist that are soluble in some gas turbine fuels. In fuels used in power generation gas turbines, however, the alkali metals are present dissolved in small amounts of water that the fuels normally contain. This water is present as suspended or separated droplets, and is not the very small amount water which is truly dissolved in the fuel. The salts of sodium and potassium are of most concern since they are the most commonly found alkali metals. The salts of lithium are of concern from a corrosion viewpoint but are not found in significant concentrations.

To counter contamination of the fuel, the gas turbine operator may do the following:

1) Allow the fuel to settle in storage tanks before use so that the fuel as burned contains little or no suspended water; or
2) Wash the fuel with high purity water and remove the water mechanically in a centrifuge or electrostatically in an electrodesalter.

These methods require accurate methods of fuel sampling and analysis to confirm that the purchased or processed fuel meets the specification for alkali metals. These methods are also extremely difficult to carry out reliably in the power plant or industrial plant environment.

BRIEF SUMMARY OF THE INVENTION

This invention incorporates a prefilter and a coalescing filter in series, in the fuel supply line to the gas turbine combustor. These components remove water, and thereby alkali metals, from the fuel oil continuously, as it is delivered to the gas turbine. The prefilter removes particulates larger than about 5 to 25 $\mu$m and protects the coalescing filter from contamination. The coalescing filter is made of a hydrophobic media that retards the movement of water as it passes through the filter. The water eventually coalesces in droplet form and is drained from the coalescer.

Another component of this invention is the optional incorporation of a water sensor and/or flow meter downstream of the coalescer than ensure that the coalescer is operating properly.

Accordingly, in one aspect, the present invention relates to a system for continuously removing alkali metal contaminants from liquid fuel supplied to a combustor of a gas turbine comprising a source of fuel; means for supplying the fuel to the gas turbine; a prefilter downstream of the source and upstream of the gas turbine for removing solid particulates from the liquid fuel; and a coalescer located downstream of the prefilter and upstream of the gas turbine for separating water containing alkali metals from the liquid fuel.

In another aspect, the invention relates to a method of continuously removing alkali metal contaminants from liquid fuel supplied to a gas turbine combustor comprising the steps of:

a) supplying liquid fuel from a source to a prefilter;
b) removing solid particulates from the liquid fuel in the prefilter;
c) subsequently, supplying the liquid fuel to a coalescer where water containing alkali contaminants are separated and removed; and
d) supplying liquid fuel from the coalescer to the gas turbine combustor.

BRIEF DESCRIPTION OF THE DRAWINGS

The FIGURE is a schematic of a system for removing alkali metal contaminants from gas turbine fuel in accordance with the invention.

DETAILED DESCRIPTION OF THE INVENTION

Figure 1:
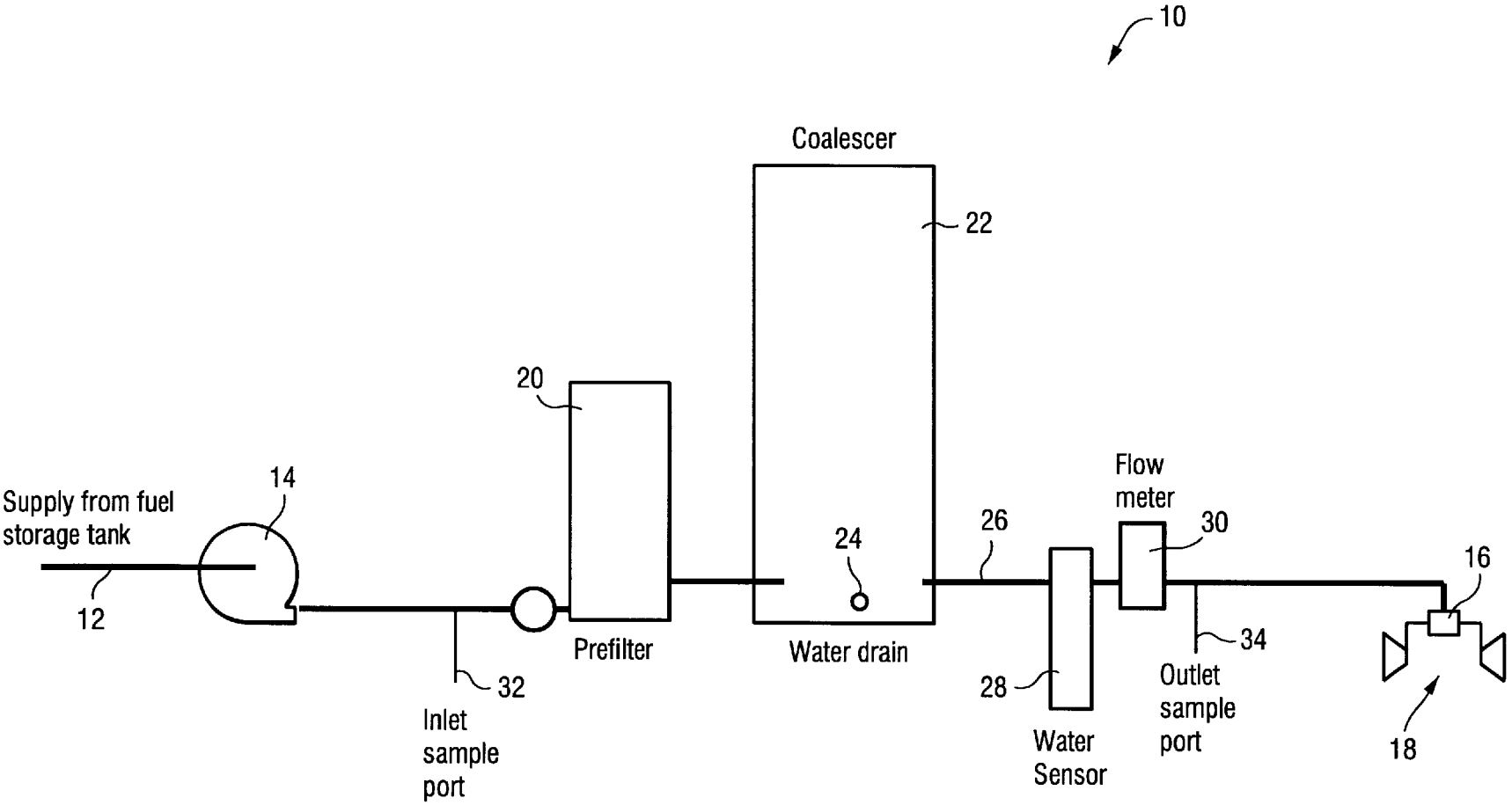

With reference to the FIGURE, a system 10 for removing alkali metals from gas turbine liquid fuels is shown in schematic form. Liquid fuel from a storage tank (not shown) flows via stream 12 and pump 14 to a combustor 16 of a gas turbine 18. The fuel can be cleaned first, however, by passing it through a prefilter 20 and a coalescer 22.

The prefilter 20 and coalescer filter 22 may be of any suitable, commercially available design. One such unit is the Aqua Sep™ Coalescer and associated prefilter available from the Pall Process Filtration Company, Hydrocarbon, Chemical, Polymer Group. The prefilter 20 is employed to remove solid particulate matter (particles larger than about 5 to 25 $\mu$m). Removal of solids protects and extends the life of the coalescer 22, reduces particulate concentration, and facilitates the separation of water from the liquid fuel oil, utilizing a hydrophobic media filter that retards the movement of water as it passes through the filter. As a result, the concentration of water in oil, in the filter, increases and encourages water droplets to come into contact and coalesce. Downstream of the filter, the larger water droplets settle by gravity and are separated from the full stream, via drain 24. Clean fuel exits the coalescer via line 26 and is supplied to the combustor 16, utilizing conventional fuel supply valves and related controls (not shown).

A water sensor 28 and flow meter 30 may be located in the line 26, downstream of the coalescer 22 to ensure that the coalescer is working properly. Such real time indication to operators that the system is performing to specification is significant. Any of a variety of conventional and commercially available water sensors may be used (for example, optical devices based on light scattering and/or absorption, hydroscopic filters that absorb water, etc.) In addition, inlet and outlet sample ports 32, 34 may be employed to further monitor the efficiency of the prefilter and coalescer apparatus.

Potential benefits of the invention are as follows:

1.) An ability to continuously supply liquid fuel to a gas turbine with an alkali metal content below 0.1 ppm, thus exceeding the specifications even for advanced gas turbines.

2.) Prevention of damage to the turbine, if contamination of the fuel occurred during transportation, i.e., after initial cleaning;

3.) Elimination of the need for a commercial supply of very high purity fuel in favor of standard purity commercially available fuel; and 4.) The need for continuous sampling and testing of the fuel to assure its suitability for use in advanced gas turbines would be eliminated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for continuously removing alkali metal contaminants from liquid fuel supplied to a combustor of a gas turbine comprising:

a source of liquid fuel; means for supplying the liquid fuel to the gas turbine; a prefilter downstream of the source and upstream of the gas turbine for removing solid particulates from the liquid fuel; and a coalescer located downstream of the prefilter and upstream of the gas turbine for separating water containing alkali metals from the liquid fuel; and further comprising a flow meter downstream of the coalescer.

2. The system of claim 1 and further comprising at least one sample port downstream of the flow meter.

3. A system for continuously removing alkali metal contaminants from liquid fuel supplied to a combustor of a gas turbine comprising:

a source of liquid fuel; means for supplying the liquid fuel to the gas turbine; a prefilter downstream of the source and upstream of the gas turbine for removing solid particulates from the liquid fuel;

a coalescer located downstream of the prefilter and upstream of the gas turbine for separating water containing alkali metals from the liquid fuel; and a water sensor downstream of the coalescer.

4. The system of claim 3 and further comprising at least one sample port downstream of a flow meter.

5. A system for continuously removing alkali metal contaminants from liquid fuel supplied to a combustor of a gas turbine comprising:

a source of liquid fuel; means for supplying the liquid fuel to the gas turbine; a prefilter downstream of the source and upstream of the gas turbine for removing solid particulates from the liquid fuel;

a coalescer located downstream of the prefilter and upstream of the gas turbine for separating water containing alkali metals from the liquid fuel; and at least one sample port downstream of the coalescer.

6. A method of continuously removing alkali metal contaminants from liquid fuel supplied to a gas turbine combustor comprising the steps of:

a) supplying liquid fuel from a source to a prefilter;

b) removing solid particulates from said liquid fuel in said prefilter;

c) subsequently, supplying the liquid fuel to a coalescer where water containing alkali contaminants are separated and removed;

d) sensing remaining water in the liquid fuel; and e) supplying liquid fuel from the coalescer to the gas turbine combustor.

* * * * *

UNITED STATES PATENT AND TRADEMARK OFFICE

CERTIFICATE OF CORRECTION

PATENT NO. : 6,526,741 B2
APPLICATION NO. : 09/738862
DATED : March 4, 2003
INVENTOR(S) : Whitehead et al.

It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Signed and Sealed this

Twenty-seventh Day of February, 2007

JON W. DUDAS
*Director of the United States Patent and Trademark Office*